United States Patent [19]

Butler et al.

[11] 4,407,241

[45] Oct. 4, 1983

[54] EXPANDABLE HYDRAULIC TAPPET WITH A VARIABLE EXIT VALVE

[75] Inventors: Gordon K. Butler, Crothersville; Don E. Beeson, Columbus, both of Ind.

[73] Assignee: Cummins Engine Company, Inc., Columbus, Ind.

[21] Appl. No.: 221,767

[22] Filed: Dec. 31, 1980

[51] Int. Cl.[3] ..... F01L 1/24

[52] U.S. Cl. ..... 123/90.16; 123/90.57; 123/501

[58] Field of Search ..... 123/90.16, 90.55, 90.57, 123/501

[56] References Cited

U.S. PATENT DOCUMENTS

| | | | |
|---|---|---|---|
| 2,339,238 | 1/1944 | Buckley | 123/90.57 |
| 2,833,257 | 5/1958 | Lengnick | 123/90.57 |
| 3,439,661 | 4/1969 | Weiler | 123/90.16 |
| 4,254,749 | 3/1981 | Kreig et al. | 123/90.55 |
| 4,285,310 | 8/1981 | Takizawa et al. | 123/90.55 |

FOREIGN PATENT DOCUMENTS

| | | | |
|---|---|---|---|
| 54-159521 | 12/1979 | Japan | 123/90.57 |

*Primary Examiner*—Craig R. Feinberg
*Assistant Examiner*—W. R. Wolfe
*Attorney, Agent, or Firm*—Neuman, Williams, Anderson & Olson

[57] ABSTRACT

An expandable hydraulic tappet with a variable exit valve is supplied for use in an internal combustion engine to selectively vary timing by altering the effective profile of a camshaft. The tappet expands to extend the drive train between the camshaft and a camshaft operated mechanism by enlarging and filling an internal hydraulic chamber with a noncompressible hydraulic fluid via an inlet port and inlet valve. The fluid is retained in the tappet chamber until a predetermined pressure is attained, when an exit valve opens to exit the pressurized fluid from the chamber at a predetermined rate. The exit valve includes a bore having a predetermined configuration to provide one or more exit flow rates and also dampen valve operation. An exit valve control means responds to the pressure within the hydraulic chamber to open and close the exit valve and vary the flow rates as desired.

20 Claims, 4 Drawing Figures

FIG. 3
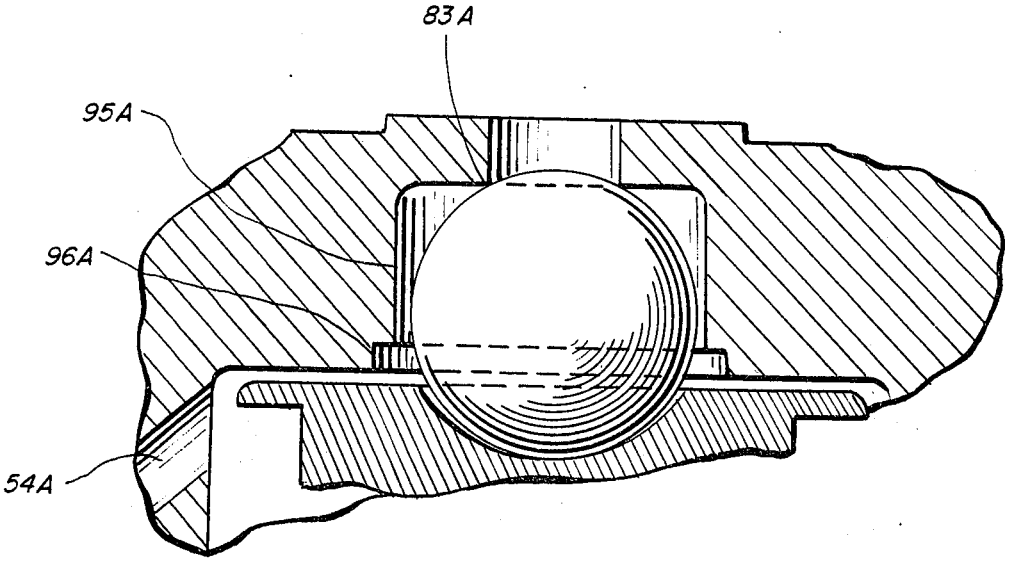
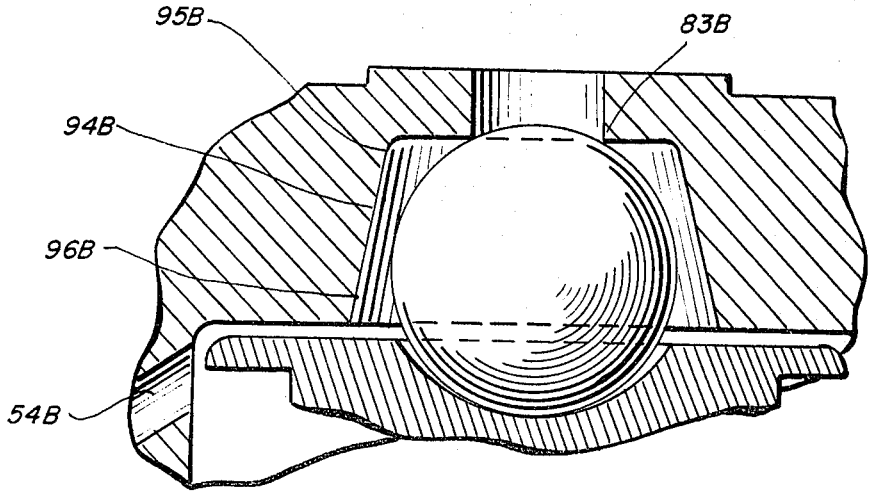
FIG. 4

EXPANDABLE HYDRAULIC TAPPET WITH A VARIABLE EXIT VALVE

BACKGROUND OF THE INVENTION

This invention relates to variable timing hydraulic tappets for use in internal combustion engines. More specifically, it relates to expandable hydraulic tappets that are pressure sensitive and vary the effective profile of a camshaft by hydraulically extending the drive train between the camshaft and a camshaft operated mechanism. Although hydraulic tappets are known in the prior art, they are not pressure sensitive, they rapidly collapse when the high pressure hydraulic fluid is vented, valves deteriorate rapidly due to the high pressures, and many require individual calibration and setting resulting in an undesireable cumulation or stack-up of tolerances.

In an effort to maximize the efficiency and power output of diesel engines, as well as lower undesireable exhaust emissions, diesel engine manufacturers have sought a reliable and consistent means of altering the timing of injection and the opening and closing of cylinder valves. In a typical diesel engine, the injectors and valves are operated by a camshaft having a plurality of precisely defined lobe profiles radially located in a timed rotational relationship. Each lobe is connected to a camshaft operated mechanism, such as a valve or injector, by a suitable combination of mechanical links, including push rods, rocker arms, etc. However, such mechanical linkage results in a rigid timing program that cannot be altered.

In the past, manufacturers have experimented with a variety of means to alter engine timing, but most have not proven successful. These efforts have included eccentric cam followers, gear phasers, overtravel tappets, helix combination injectors, hydraulic intensifiers, and variable task hydraulic tappets.

Prior art variable length hydraulic tappets have also been used to vary timing, but they have met only limited success. Hydraulic tappets are interposed between the camshaft and camshaft operated mechanism and alter engine timing by selectively lengthening the timing drive train, thereby changing the effective profile of the camshaft. Typically, the collapsed or shortened tappet permits the camshaft operated mechanism to function in its normal timing sequence. When the tappet is lengthened, by trapping hydraulic (non-compressible) fluid in an internal tappet chamber, the drive train between the camshaft and camshaft operated mechanism is lengthened, advancing the normal timing sequence. Conversely, such a tappet may be used to retard timing by selectively collapsing it to shorten the camshaft drive train.

However, these tappets suffer various deficiencies, including sensitivity to hydraulic fluid viscosity and engine speed, non-universal design, non-uniform pressure maintenance, failure to self prime from dry engine start up, irregular transient response, an excessive failure rate due to the high hydraulic pressures generated, and individual calibration resulting in a stack-up of tolerances. In addition, variable length hydraulic tappets are limited to use where the camshaft operated mechanism is not sensitive to increased pressure loading, cam link overtravel, and rapid tappet collapse. Thus, such prior art hydraulic tappets are unsuitable for use with injectors and are restricted to use with camshaft operated valves. Specifically, camshaft link overtravel and increased injection camshaft pressure or train loads may burst the injector cup, reduce injection duration and throttle fueling in and advance mode. Also, rapid tappet collapse may interfere with a sharp, clean termination of injection and permit hot exhaust gases to escape into the injector.

Tappets that are pressure sensitive further suffer from exit valve failure resulting from the extreme hydraulic pressures. During pressure blowdown, valve components and control means impact several times at excessive velocities, causing fatigue failure of the components and seats.

SUMMARY OF THE INVENTION

It is an object of the present invention to overcome the aforementioned difficulties and shortcomings of the prior art for selectively varying the effective profile of a camshaft to alter engine timing.

Another object of the invention is to provide a novel, reliable and simple apparatus for selectively altering the timing of an internal combustion engine, including diesel fuel injection.

Still another object of the invention is to provide a hydraulic tappet that is pressure limiting, yet does not rapidly collapse when said predetermined pressure is attained.

Still another object of the invention is to provide a hydraulic tappet that exits high pressure fluid at a plurality of flow rates.

Still another object of the invention is to dampen tappet valve operation so as to extend valve life.

These and other objects are obtained by providing a pressure controlled expandable hydraulic tappet for use in an internal combustion engine. The tappet selectively varies the effective profile of a camshaft by extending the drive train between the camshaft and a camshaft operated mechanism, and contracting when the drive train pressure reaches a predetermined maximum.

The tappet includes a housing having an internal piston receiving means. Expandable piston means are reciprocally disposed within the housing and define a load cell chamber with an inlet port and exit port. Hydraulic fluid is supplied to the inlet port and to an inlet valve which is disposed between the fluid source and chamber. The inlet valve, when selectively opened, admits fluid to the chamber expanding the piston means, and when closed seals the chamber. An exit valve is connected to the exit port to selectively open and seal the chamber. The exit valve has one or more exit flow rates and is provided with dampening means to ease the closing of the valve. An exit valve control means is also provided which is responsive to the pressure within the chamber thereby altering the exit flow rate.

DESCRIPTION OF THE DRAWINGS

All of the above is more fully explained in the detailed description of the preferred form of the invention which follows. This description is illustrated by the accompanying drawings wherein:

FIGS. 3 and 4 are enlarged fragmentary cross-sectional views of the tappet of FIG. 2, showing the exit valve means thereof disposed in bores of alternative design.

DESCRIPTION OF THE PREFERRED EMBODIMENT

While a specific preferred embodiment is disclosed herein, oriented in a preferred direction, it is understood that variations in configuration and orientation are within the scope of the present invention.

Figure 1:
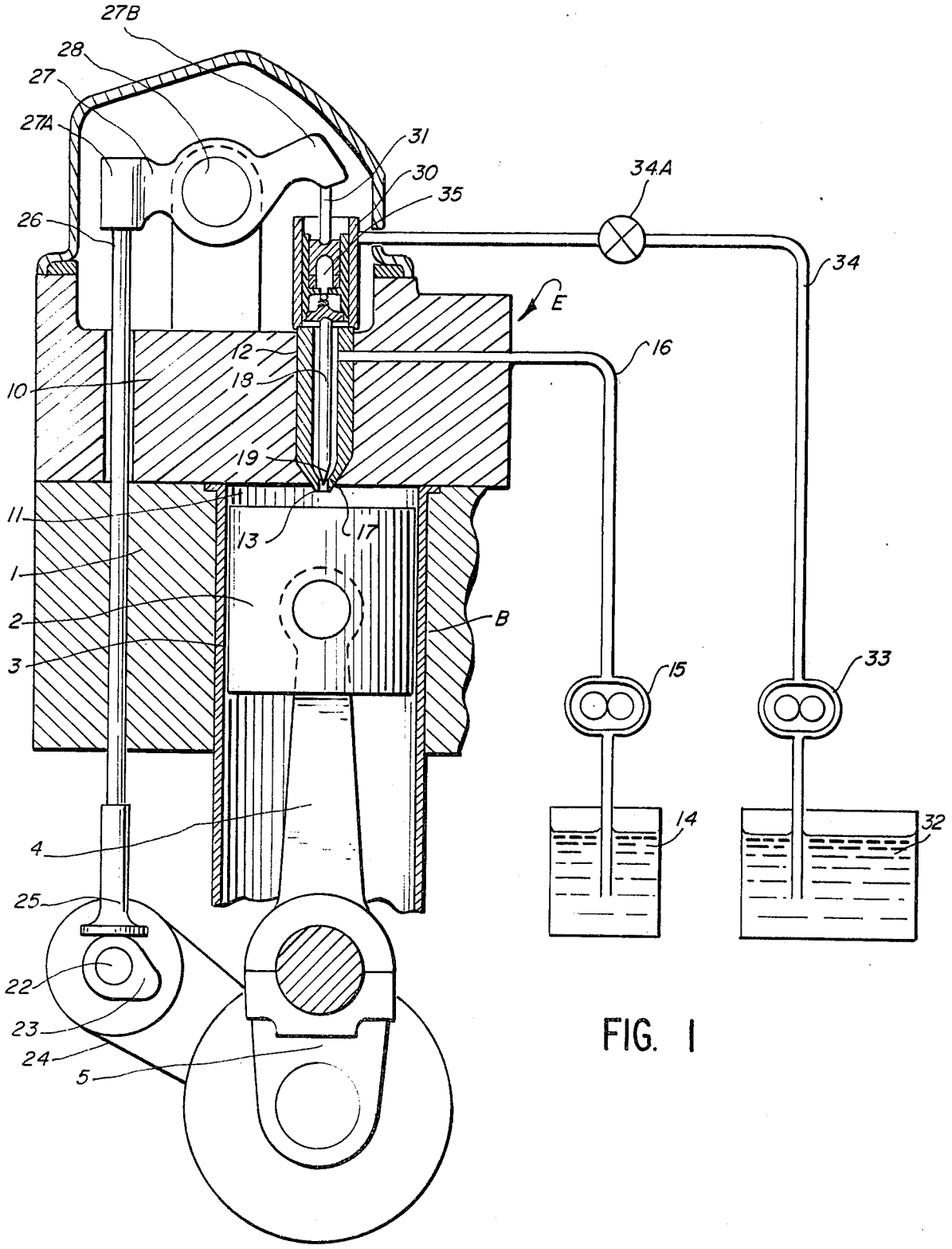
FIG. 1 is a fragmentary schematic illustration of one cylinder of a diesel engine, partially in vertical section, utilizing one form of the improved expandable hydraulic tappet to vary the effective profile of a camshaft by extending the drive train between the camshaft and a camshaft operated fuel injector.

Referring to FIG. 1, a diesel engine E of conventional design is shown which includes a cylinder block 1 having a piston 2 reciprocally disposed within a piston liner 3, the latter being fitted into a cylinder bore B formed in the block. A connecting rod 4 joins the piston 2 to a crankshaft 5 which is rotatably mounted within the block. The number of bores B formed in the block will depend upon the operational demands imposed on the engine.

A cylinder head 10, superposed and rigidly attached to the block 1, coacts with the liner 3 and piston 2 to define a compression chamber 11. A fuel injector 12 is mounted in the head and has its tip or cup 13 disposed within the uppermost portion of said chamber 11. The exact configuration of the injector is well known in the art and, except as noted hereinafter, the design thereof is not necessary to an understanding of the present invention.

Fuel is supplied to the injector 12 from a suitable source 14 by a fuel pump 15 of conventional design through a fuel line 16. The fuel enters the injector 12 and is metered by any well known means to a sack 17 located in or adjacent to the injector tip 13. A reciprocating plunger 18 is mounted within the injector and typically extends the length thereof with a point 19 that extends into the sack 17.

A camshaft 22 having a selected number of eccentric lobes 23 arranged in a predetermined timed rotational relationship to one another is mounted for rotation within said block and is connected to the crankshaft 5 by timing means 24 so as to maintain a fixed timed relationship coordinating the movement of a cam follower 25, engaging the lobe periphery, with that of piston 2. The timing means may be gears, chains, or any other mechanism well known in the art. Cam follower 25 is rigidly connected to a push rod 26 and moves therewith as a unit. An oscillating rocker arm 27 is mounted on a shaft 28, disposed adjacent the upper end of rod 26. One end 27A of arm 27 is connected to push rod 26 and a second end 27B of the rocker arm, disposed on the opposite side of shaft 28, is in contact with one end of a rocker link 31. The link engages the hydraulic tappet 30 which in turn contacts the uppermost end of the injector plunger 18.

Hydraulic fluid is supplied to the tappet from a convenient source 32 by a suitable pump 33 through a fluid line 34. Disposed within line 34 is a valve 34A. The fluid, upon entering the tappet fills an internal chamber 35 formed therein and effects expansion or contraction of a piston assembly disposed within the tappet chamber. The tappet will be described in more detail hereinafter. Relative movement of various components of the piston assembly lengthens or shortens the drive train (e.g. follower 25, rod 26, rocker arm 27, link 31 and tappet 30) between the camshaft 22 and the injector 12, thereby changing the camshaft profile and injector timing. The tappet may be positioned at any convenient location within the drive train.

When the piston assembly is operating in a retracted mode, the length of the drive train and consequently the profile of the camshaft will remain unchanged. Specifically, the crankshaft 5 and camshaft 22 rotate in fixed timed relationship with the reciprocal movement of the piston 2. When the drive train is in a relaxed mode, as illustrated (i.e. the camshaft follower 25 is not raised by camshaft lobe 23), the injector plunger 18 is also retracted or raised with respect to the tip 13. During this time, fuel 14 is metered into the injector with a predetermined amount pooling in the injector sack 17. Continued rotation of camshaft lobe 23 causes the drive train to depress the piston assembly, which acting as a solid link, also depresses the injector plunger 18. As the plunger is depressed, the pointed end 19 thereof moves into the sack 17 expelling therefrom under high pressure (approximately 3,000 p.s.i.), the metered fuel into the combustion chamber 11. The plunger is maintained in its depressed position for a predetermined duration and under a given pressure depending upon the configuration of the camshaft lobe 23.

When it is desirable to advance injection timing the tappet piston assembly is expanded hydraulically to lengthen the aforementioned drive train, thereby selectively altering the camshaft profile. In operation, beginning with the relaxed drive train mode, hydraulic fluid from source 32 is metered into the tappet chamber 35 causing the piston assembly to expand in an axial direction. As noted earlier, continued rotation of the camshaft lobe 23 depresses the injector plunger 18 and due to the expanded piston assembly, the drive train is lengthened causing the injector plunger 18 to experience excessive travel and pressure. Unless the tappet piston assembly contracts to its relaxed position following injection of the fuel and seating of the plunger tip in the fuel sack the excessive travel and pressure will tend to burst the fuel sack 17 and destroy the injector 12. Moreover, it is important that the plunger is maintained in its depressed position relative to the tip 13 for a predetermined duration and under a predetermined pressure, otherwise the plunger will prematurely retract allowing either combustion gases to escape into the fuel sack 17 or fuel to dribble into the combustion chamber after injection rather than being sharply cut-off. Either of these latter conditions is unacceptable.

Applicant's novel invention provides means for overcoming these problems by exiting the pressurized hydraulic fluid from the tappet chamber 35 in response to the pressure generated within the chamber by the continued compression of the piston assembly by the camshaft drive train. The exiting of the fluid causes the tappet piston assembly to contract yet maintain a relatively steady predetermined pressure against the injector plunger, as desired for optimum diesel operation. When properly designed, camshaft rotation pressures will collapse the tappet piston assemblies allowing the latter to revert to its relaxed or retracted state during each cycle. Thus, advanced or retarded mode operation may be selected for each cycle.

Figure 2:
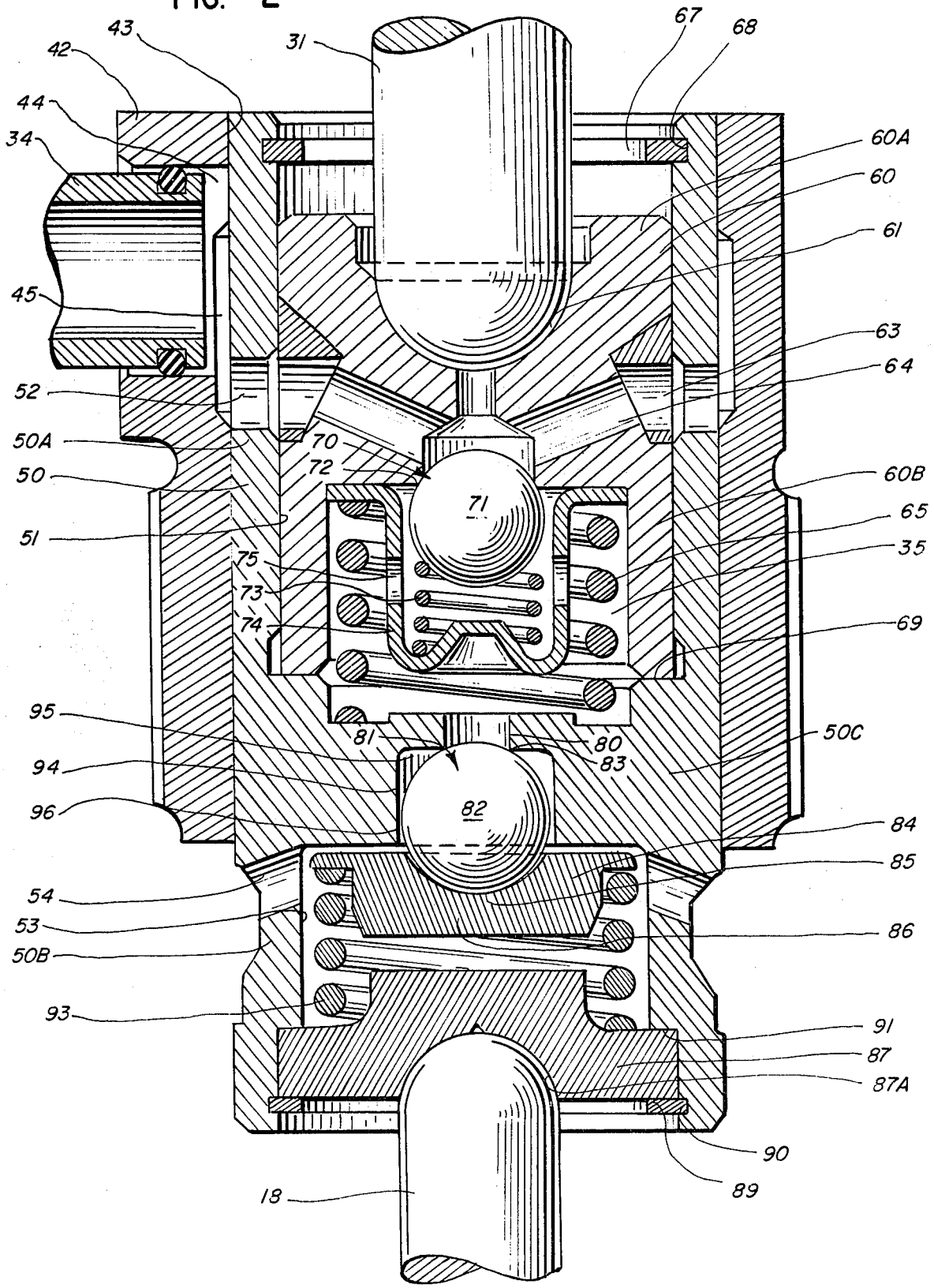
FIG. 2 is an enlarged fragmentary vertical sectional view of the improved expandable hydraulic tappet of FIG. 1 shown in a contracted state.

The detailed operation of applicants' pressure limiting tappet is explained with reference to FIG. 2 and includes a housing 42 having a longitudinal cylindrical bore 43 or piston receiving means formed therein. An orifice 44, connected to hydraulic fluid line 34, is formed in the housing and communicates with an annular groove 45 provided in the surface defining bore 43. The hydraulic fluid entering orifice 44 may be engine oil circulated at conventional pressures. The tappet housing 42 may be connected to a cylinder head or injector adapter (not shown) and is typically interposed between link 31 and a second link 18 (e.g. injector plunger) or other camshaft operated mechanism (not shown).

A first component 50 of the piston assembly is disposed within the bore 43 for reciprocal coaxial movement and forms a tight hydraulic seal therewith. The component 50 reciprocates within the bore and has a generally H-shaped axial cross section. The upper portion 50A thereof is provided with a cylindrical cavity 51 that is coaxial with the bore 43 of housing 42. A plurality of annularly spaced ports 52 are formed in the upper portion 50A and allow the hydraulic fluid from orifice 44 to flow to the surface of the cavity 51. Axial placement of these ports 52 on the upper portion 50A is left to the discretion of the user provided they do not unnecessarily throttle fluid flow as the first piston component 50 reciprocates within the bore 43.

The lower portion 50B of the piston component 50 defines a lower cavity 53 that is generally cylindrical and coaxial with the bore 43. One or more passages 54 vent cavity 53 to the outside. A central portion 50C of component 50 separates cavities 51, 53 and forms the floor of internal chamber 35. The central portion 50C is provided with an exit port having the lower end thereof counter-bored as will be described in more detail hereinafter.

A second component 60 of the piston assembly reciprocates within cavity 51 of component 50 and forms a tight hydraulic seal therewith. An end 60A of component 60 has a concave configuration and removably receives the end of link 31 which forms a part of a camshaft drive train. The opposite or lower end of component 60 forms a skirt 60B which defines the upper surface of chamber 35. As aforenoted, the lower surface of chamber 35 is defined by center portion 50c. An annular groove 63 is formed in the exterior of the second component 60 mediate end 60A and skirt 60B. The groove 63 communicates with chamber 35 via a plurality of internal passages 64. The inner ends of passages 64 terminate at a valve 70 disposed at the upper end of chamber 35.

A coiled pumping spring 65 is disposed within chamber 35 between the first and second piston components 50, 60 and urges the latter apart so as to maintain contact between them and their respective link 31 and plunger 18. Movement of component 60 within cavity 51 is constrained at the top by a snap-in retainer ring 67 protruding into cavity 51 and seated in a groove 68 formed in the cavity wall. Downward movement of the component 60 is limited by the skirt 60B engaging an annular shoulder 69 formed adjacent to but spaced axially from the base of cavity 51. The configuration of retainer ring 67 and its location may be varied from that shown provided that movement of component 60 with respect to component 50 does not throttle the supply of hydraulic fluid from ports 52 through the groove 63. Movement of the component 50 within the housing bore 43 may be similarly constrained, although, to enhance clarity, it has not been illustrated. Alternative means of restraining movement may be utilized as necessary or desirable, including a limitation on the amount of drive-train lash or slack.

The inlet valve 70 interposed chamber 35 and fluid supply line 34 is disposed within the interior of the piston 60 and includes a ball 71 and mating seat 72, although many varieties are suitable. An inlet spring 73, such as coiled expansion spring, and a spring retainer 74 are disposed beneath ball 71 and coact to bias the latter to its closed position against seat 72 thereby closing off the inner ends of passage 64. The inlet valve remains closed by reason of spring 73 unless the pressure of the hydraulic fluid entering port 53 is above a predetermined amount and the drive train is in its relaxed mode. Apertures 75 in spring retainer 74 insure free fluid flow from the open inlet valve 70 to the lower portion of chamber 35.

An exit port 80 is formed in the center portion 50C of component 50 to effect communication between cavity 51 and cavity 53. An exit valve 81 is positioned at the downstream and of port 80 and includes a ball 82 and mating seat 83, although many varieties are suitable. A ball guide 84 subtends ball 82 and is disposed within the upper portion of cavity 53 for reciprocal movement therein. The upper surface 85 of guide 84 is dished and cradles the underside of ball 80. The lower end portion 86 of guide 84 is engaged by the upper end of a coil spring 93. The opposite, or lower, end of spring 93 engages a socket piece 87 which is positioned at the lower end of cavity 53. The socket piece 87 is firmly held in place between a snap-in retainer ring 89 projecting into the cavity and seated in a corresponding groove 90 formed in the cavity wall and an annular shoulder 91 formed in the cavity wall and spaced axially from groove 90. The underside of socket piece 87 has a dished surface 87A to removably receive the upper end of injector plunger 18.

Spring 93 through guide 84 urges ball 82 against seat 83. Movement of the ball away from seat 83 is limited by guide 84 engaging socket 87.

The underside of center portion 50C is counter-bored at 94. The diameter of the counter bore 94 is greater than that of the ball 82. The counter bore 94 includes a first portion 95 nearest the valve seat 83 and a second portion 96 downstream from the valve seat. As described in more detail below, the first portion 95 causes a predetermined volume of fluid to be trapped adjacent the seat 83 and thus, dampens movment of the ball 82 toward the seat. The second portion 96 of the counter bore forms a fluid control area that modulates the rate of fluid flow from the chamber 35 through the exit port 80 and out passages 54.

During operation in the retarded mode, the tappet piston components are contracted thereby maintaining a shortened drive train between the camshaft and injector plunger. When the valve 34A (FIG. 1) is closed the hydraulic fluid pressure in the line 34 and the passageway 64 is zero or near zero. Absent this upstream pressure on the inlet port side of valve 70, the inlet spring 73 maintains ball 71 against seat 72 sealing the chamber 35 and blocking the entry of any fluid thereinto. As the camshaft profile rotates to its relaxed mode, (i.e. the camshaft lobe 23 is not in contact with or exerting pressure against follower 25, as shown in FIG. 1), the pumping spring 65 urges piston component 60 to move away from exit port 80, expanding the piston assembly and taking up any slack in the camshaft drive train. A light negative pressure is created in the chamber because it is sealed; however, the force of the valve spring 73 is sufficient to maintain the ball in sealing relation against its seat. As the camshaft rotates to its operating mode, lobe 23 causes a downward pressure to be exerted on link 31. This pressure overcomes the force of spring 65, causing component 60 to retract toward the exit port 80 of component 50 until component 60 bears against an internal shoulder 69 formed in component 50. The tappet now acts as a solid link and thus, while in the retarded mode, has no effect on engine timing and merely acts as a lash adjuster.

During operation in the advanced mode, the tappet piston assembly is expanded so as to lengthen the drive train. Beginning with component 60 in its retracted position (as shown in FIG. 2), valve 34A, FIG. 1, in line 34 is opened thereby causing pressurized hydraulic fluid to be present at orifice 44. In a typical engine, the fluid (oil) operating pressure is approximately 15 p.s.i. The hydraulic fluid fills groove 45 and flows through ports 52, groove 63 and passages 64 to the inlet upstream side of valve 70. The force created by the pressure of the hydraulic fluid against the exposed surface portion of ball 71 is greater than the counter force of valve spring 73, thereby unseating the ball 71 from the seat 72 and permitting the fluid to enter chamber 35. While the camshaft profile is in its relaxed mode, pumping spring 65 again moves component 60 away from component 50, allowing enlarged chamber 35 to fill with hydraulic fluid. The fluid is maintained in chamber 35 by the exit valve, which is biased to a closed postion thereby sealing the fluid in the chamber. As the camshaft rotates to its operating mode (i.e. lobe 23 engages follower 25) pressure is exerted on the camshaft drive train, which, in turn, rapidly and significantly increases the pressure of the hydraulic fluid within chamber 35 above the biasing force on the ball 71 of valve 70. The trapped fluid being incompressible results in the piston assembly functioning as a solid link in the drive train. By reason of this sequence of events, the injector plunger 18 starts its downward movement sooner than normal, advancing fuel injection. The amount of advance is dependent upon the amount of extension of piston assembly.

As the camshaft lobe 23 continues to rotate and move follower 25 to its maximum extension, the drive train load pressure increases the hydraulic pressure within the chamber 35. The exit valve ball 82 remains seated until the force generated by the chamber pressure against the area of the inlet side of valve 81 overcomes the force of the load cell spring 93 and the inertia effects of the valve ball 82 and ball guide 84. When the ball 82 is removed from its seat 83, the pressure in the chamber 35 no longer acts only on the exit port area but on the entire diametrical ball area. The increased area results in an increased force that accelerates the downward movement of the ball 82 and ball guide 84 away from the seat 83. Thus, component 50 begins to move downwardly relative to the tappet housing 42, preventing the camshaft drive train pressure from overshooting and possibly causing the plunger 18 to damage the injector 12. However, due to the rapid acceleration of the ball 82 from the valve seat, the flow area in the valve must be restricted or the drive train load will prematurely collapse. The fluid exit flow rate is restricted by limiting the toroidal shaped differential area between the exit ball 82 and the surface of the counter bore 94, said area being measured through the ball center perpendicular to the longitudinal axis of the housing. The contacting of guide 84 and rocker piece 87 limit the axial ball movement so that the center of the ball does not pass beyond the downstream end of counter bore 94.

The configuration and size of the differential area may be altered as desired to provide any number of flow rates. If a single flow rate is desired, the counter bore 94 may be cylindrical resulting in a differential area that is independent of ball position, as shown in FIG. 2. Alternatively, the counter bore 94 may be stepped resulting in a counter bore having a plurality of different diameters as shown in FIG. 3. In the FIG. 3 configuration, one portion 95A of the counter bore nearest the valve seat may have one diameter, resulting in a first differential area and flow rate, and a second portion 96A near the exit ports 54A may have a larger diameter, resulting in a larger differential area and greater flow rate, thus increasing the flow rate as the increased chamber pressure moves ball 82A farther away from seat 83A.

Another alternative counter bore configuration is illustrated in FIG. 4 and embodies a tapered counter bore 94B having a smaller diameter 95B near the valve seat 83B and a larger diameter 96B near the exit ports 54B. Thus, any desirable configuration for the counter bore may be utilized, depending upon manufacturing tolerances and load collapse characteristics.

The exit flow rate may also be controlled by confining the axial movement of the ball to restrict the flow area between the ball 82 and seat 83. However, the sum of the manufacturing tolerances for the valve seat, seat diameter, ball diameter, and thickness of the ball guide and socket piece cause tolerances stack-ups that result in unacceptable performance variations.

In addition to preventing premature load collapse, the differential flow area also dampens ball movement when the ball returns to its seated sealing position. Referring to FIG. 2, as chamber pressure decreases, ball 82 is urged towards its seat 83 by spring 93. Oil is trapped in the upper toroidal portion 95 of the counter bore 94 and is displaced only by flowing through the restricted differential area between the periphery of ball 82 and the wall of the counter bore resulting in the ball gently seating, thus significantly prolonging valve life.

The invention has been described and illustrated in detail with reference to a particular preferred embodiment and the operation thereof, but it is understood that variations and substitutions of equivalent mechanisms and bore configurations can be effected within the scope of this invention.

What is claimed is:

1. A pressure controlled expandable hydraulic tappet for use in an internal combustion engine to selectively vary the effective profile of a camshaft by extending the drive train between said camshaft and a camshaft operated mechanism, said tappet comprising:

a housing having an internal piston receiving means;

expandable piston means reciprocally disposed within said housing, said piston means defining a load cell chamber having an inlet port and an exit port;

a supply of hydraulic fluid connected to said inlet port;

inlet valve means interposed said fluid supply and said chamber and biased to assume a closed position, said valve means opening to admit hydraulic fluid into said chamber expanding said piston means when a predetermined valve opening force is exerted on the upstream side of said valve means and said inlet valve means resuming a closed position and entrapping said fluid within said chamber when the valve closing force downstream of said valve means exceeds said valve opening force;

exit valve means connected to said exit port for selectively sealing or opening said chamber, said exit valve opening to effect exiting of hydraulic fluid from said chamber at a predetermined rate when pressure within said chamber exceeds said predetermined amount, said exit valve means having flow throttling means within said tappet for controling the rate of closing of said exit valve and for controlling the flow rate at which fluid exits through said exit valve means, said exit valve means including an exit ball, a mating seat to accommodate in sealing relation said exit ball, and an exit valve counter-bore extending downstream from said seat, said exit valve counter-bore having a diameter slightly greater than the diameter of said exit ball, said exit ball being disposed for reciprocal movement substantially within said counter-bore and defining in combination with said counter-bore an annular passageway that limits the fluid flow rate therethrough; and bias means for closing said exit valve and sealing hydraulic fluid within said chamber when the pressure within said chamber is below a predetermined amount.

2. A tappet as in claim 1 wherein said housing defines a cylindrical piston receiving means.

3. A tappet as in claim 1 wherein said piston means is biased to an expanded mode.

4. A tappet as in claim 1 wherein the supply of hydraulic fluid is at a low pressure.

5. A tappet as in claim 1 wherein said inlet valve is pressure sensitive.

6. A tappet as in claim 1 wherein said inlet valve control means is responsive to the pressure of said hydraulic fluid supply, a preselected valve closing bias, and any pressure within said chamber.

7. A tappet as in claim 1 wherein said exit valve counter-bore is cylindrical.

8. A tappet as in claim 1 wherein said exit valve counter-bore has a first portion adjacent said seat with a first diameter and a second portion downstream of said first portion with a second diameter different than said first diameter to define first and second flow throttling passageways.

9. A tappet as in claim 1 wherein said exit valve counter-bore is substantially frustoconical.

10. A tappet as in claim 1 wherein the exit flow rate of the hydraulic fluid varies in proportion to the differential area between said exit ball and said exit valve bore, said area measured through the ball center perpendicular to the reciprocating axis of said exit ball.

11. A tappet as in claim 1 wherein said bias means includes a ball guide interposed said ball and a spring means urging said ball into contact with said mating seat.

12. A tappet as in claim 1 wherein said exit valve counter-bore and said exit ball also defining in combination a generally toroidal shaped volume proximate said mating seat, said volume containing entrapped hydraulic fluid which flows past said exit ball through said counter-bore at a controlled rate as said exit ball moves from an open position to a closed position displacing said entrapped hydraulic fluid, thereby cushioning the seating of said ball onto said mating seat.

13. A tappet as in claim 1 wherein said inlet valve comprises a ball, mating seat, and bias means to seat said ball.

14. A tappet as in claim 13 wherein said ball is biased towards said seat by an inlet spring subtending said ball.

15. A tappet as in claim 1 wherein said piston means comprises first and second piston components.

16. A tappet as in claim 15 wherein said first piston component is operatively connected to said camshaft operated item.

17. A tappet as in claim 15 wherein said second piston component is operatively connected to said camshaft.

18. A tappet as in claim 15 wherein said first piston component defines an upper chamber-forming cavity for said second piston component and a lower cavity coaxial therewith.

19. A tappet as in claim 18 wherein the second piston component is reciprocally disposed within said upper chamber-forming cavity for movement coaxial with the reciprocating axis of said expandable piston means and forms a hydraulic-tight seal therewith, said second piston component being moveable relative to said first piston component from a retracted position to an extended position, thereby effecting expansion of said piston means.

20. A tappet as in claim 18 wherein said exit port effects communication between said upper chamber-forming cavity and said lower cavity.

* * * * *